United States Patent [19]

Edling et al.

[11] 4,080,796

[45] Mar. 28, 1978

[54] BOTTOM-SUPPORTED VESSEL FOR PERFORMING SUBAQUEOUS OPERATIONS AND METHOD OF PLACING A BOTTOM-SUPPORTED VESSEL IN POSITION FOR PERFORMING SUBAQUEOUS OPERATIONS

[75] Inventors: Porter Russell Edling, Houston; Gerhard Helmut Reusswig, Conroe, both of Tex.

[73] Assignee: The Offshore Company, Houston, Tex.

[21] Appl. No.: 682,068

[22] Filed: Apr. 30, 1976

[51] Int. Cl.[2] ..... E02D 21/00

[52] U.S. Cl. ..... 61/88; 61/91; 61/103

[58] Field of Search ..... 61/46.5, 46, 88, 91, 61/103; 114/.5 D; 175/9

[56] References Cited

U.S. PATENT DOCUMENTS

| | | | |
|---|---|---|---|
| 2,534,480 | 12/1950 | Shannon | 61/46.5 X |
| 2,622,404 | 12/1952 | Rice | 61/46.5 |

FOREIGN PATENT DOCUMENTS

| | | | |
|---|---|---|---|
| 1,366,164 | 6/1964 | France | 61/88 |

*Primary Examiner*—Jacob Shapiro
*Attorney, Agent, or Firm*—Vinson & Elkins

[57] ABSTRACT

A bottom-supported vessel from which subaqueous operations may be performed. The vessel includes a platform and a mat, both of which are configured to permit the platform to nest within the mat while the vessel is floating. The mat is submersible and is adapted to be buried into the soil beneath the ocean floor to provide support for the platform. Legs extend from the mat to the platform and support the platform when the mat is buried. A method of placing a bottom-supported vessel in position for performing subaqueous operations.

3 Claims, 11 Drawing Figures fig.7
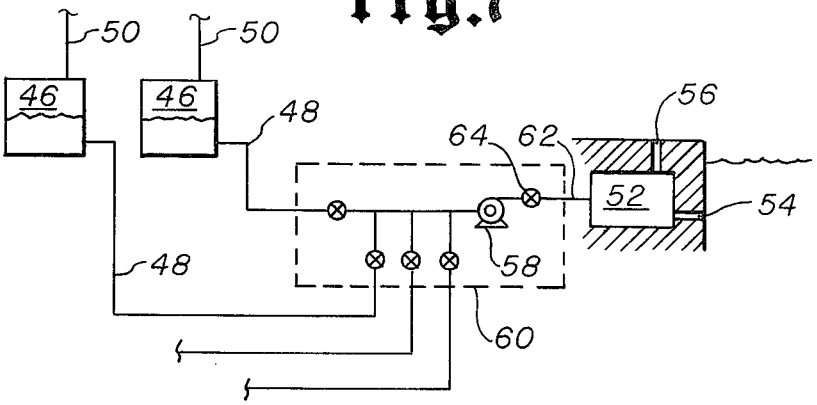
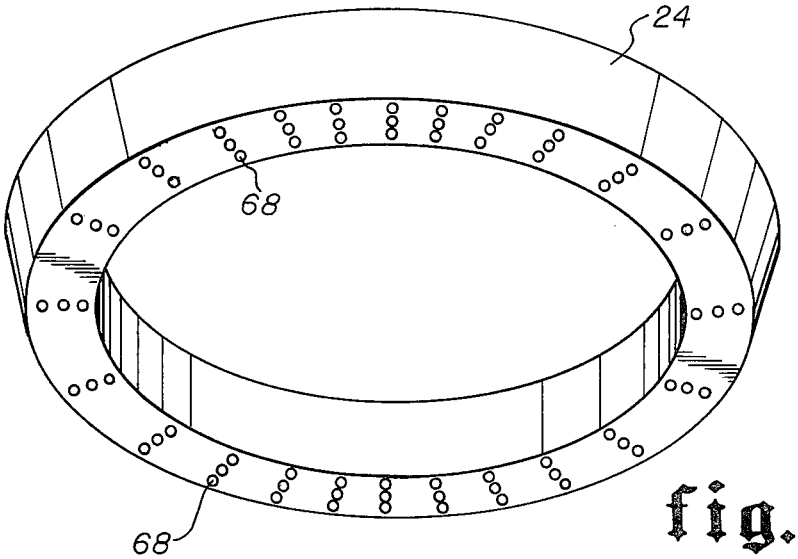
fig.8
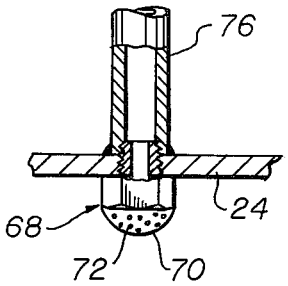
fig.9

BOTTOM-SUPPORTED VESSEL FOR PERFORMING SUBAQUEOUS OPERATIONS AND METHOD OF PLACING A BOTTOM-SUPPORTED VESSEL IN POSITION FOR PERFORMING SUBAQUEOUS OPERATIONS

BACKGROUND AND OBJECTS OF THE INVENTION

This invention relates to a bottom-supported vessel which is floated into position and then embedded in the seabed whereby the vessel is supported by the seabed while subaqueous operations are performed from the vessel.

Bottom-supported vessels from which subaqueous operations may be performed are disclosed in U.S. Letters Pat. Nos. 3,738,113 to Madary et al; 3,433,024 to Diamond et al; 3,021,680 to Hayward; 2,938,353 to Vorenkamp; 2,895,301 to Casagrande et al; and 2,622,404 to Rice. The aforementioned Hayward 3,021,680 and Diamond et al; 3,433,024 patents disclose a vessel including a submersible buoyant barge which is submerged to provide support for the work platform. In the aforementioned Vorenkamp, 29,622,353, Casagrande et al 2,895,301 and Rice 2,622,404 patents, the disclosed submersible barge is partially embedded into the ocean floor.

U.S. Letters Pat. No. 3,738,113 to Madary et al discloses an offshore drilling structure in which drilling operations are performed through a support leg extending from the drilling platform to the ocean floor.

U.S. Pat. No. 3,740,956 to Guy et al discloses a circular drilling structure which is floated into position, ballasted until it rests upon the ocean floor and filled with bulk material to create an artificial drilling island.

All of the offshore vessels disclosed in the aforementioned U.S. Letters Patents are, for one reason or another, somewhat disadvantageous for use in the shallow water, fast ice regions of the arctic seas.

The water depth in the fast ice region of the arctic seas is approximately 5 to 60 feet. To perform subaqueous operations in this region, a vessel preferably has a shallow draft. The ice thickness in the fast ice region of the artic seas is on the order of 7 feet. A vessel from which subaqueous operations will be performed in the fast ice region should be capable of remaining in an operating mode and withstanding the forces due to ice loads without assistance from other equipment to reduce its operating cost and maximize safety and reliability. Additionally, the vessel should be capable of setting its own required support foundation. Ice loads on the vessel and ice scouring effects should be kept to a minimum. Additionally, the vessel should be one that is readily movable from one position to another.

It is, therefore, an object of this invention to provide an improved bottom-supported vessel for performing subaqueous operations which has a minimal draft and which is capable of withstanding loads due to enroaching ice.

It is another object of this invention to provide an improved method for placing into operating position a vessel for performing subaqueous operations.

This and other objects and features of advantage of this invention will be apparent from the drawings, the written description of the preferred embodiment, and the appended claims.

BRIEF DESCRIPTION OF THE DRAWINGS

In the drawings wherein like numerals indicate like parts and wherein an illustrative embodiment of this invention is shown.

FIG. 7 is a schematic illustration of the ballasting and deballasting system for the mat of FIG. 5;

FIG. 8 is a schematic perspective of the bottom of the mat of FIG. 5;

FIG. 9 is a detail of the nozzles shown in FIG. 8;

DESCRIPTION OF THE PREFERRED EMBODIMENT

Figure 1:
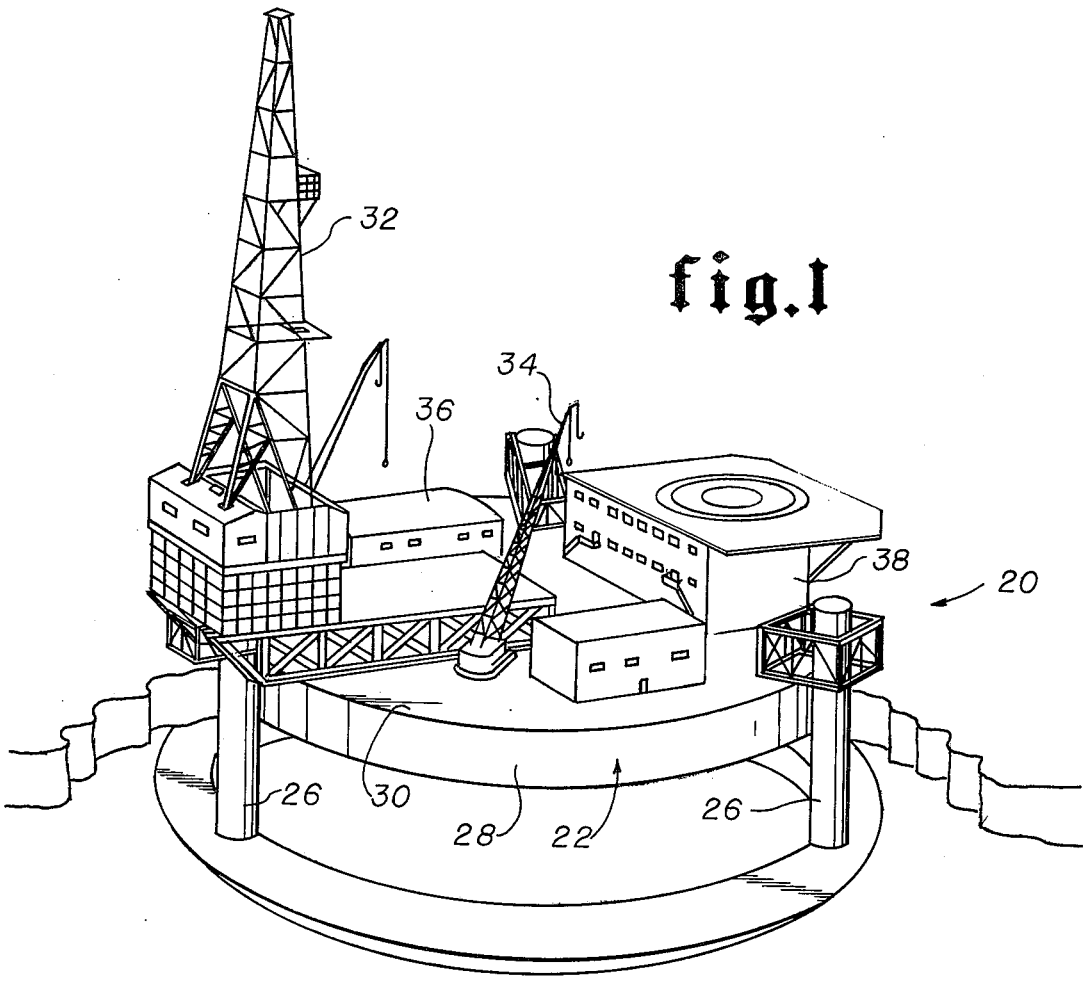
FIG. 1 is a perspective view of a vessel in accordance with this invention in a position for performing subaqueous operations in the fast ice region of the arctic seas.

The method and vessel of this invention may be used in many situations in which it is desirable to employ a minimum draft vessel for performing subaqueous operations, which vessel is capable of withstanding usually large lateral loads. However, the improved vessel according to this invention is particularly designed to be used in the shallow, fast ice regions of the arctic seas. For convenience of illustration, the preferred vessel described herein is shown to be equipped for the performance of subaqueous drilling operations.

FIGS. 1 through 4 illustrate the preferred overall configuration of the vessel. The vessel, generally indicated at 20, includes a floatable platform 22 from which the subaqueous operations will be performed, a ballastible and deballastible mat 24 adapted to be buried into the seabed, legs 26 extending from the mat 24 to the platform 22, and means for moving the leg 26 with respect to the platform 22.

The platform 22 includes a buoyant hull 28 and a deck 30 on top of the hull. The buoyant hull 28 permits the platform 22 to be floated from one position to another. The subaqueous operations are designed to be performed from deck 30 and for this purpose the deck 30 may have positioned upon it any desired equipment such as a derrick, crane 34, and buildings such as living quarters 36 and storage areas 38.

The platform 22 is shaped to minimize its draft, maximize the work area per overall dimension, and minimize the distance between the legs 26. The geometric configuration which provides the maximum volume to skin area ratio and therefore provides the maximum displacement per structural weight, which in turn minimizes the draft of the platform 22, is a cylinder. The platform 22 therefore preferably is designed whereby the hull 28 has a cylindrical outer wall and a flat bottom to minimize the draft of platform 22. The deck 30 preferably is circular to provide the maximum work area per overall dimension.

The mat 24 assists in minimizing the draft of vessel 20 when it is in a floating mode and provides a bottom support for the vessel when it is in a subaqueous operating mode. To assist in minimizing the draft of vessel 20, the mat 24 is buoyant and both the platform 22 and the mat 24 are configured to permit the mat to encircle the platform and float therearound. Preferably the outer configuration of the hull 28 and the inner configuration of the mat 24 is such that the hull 28 can nest within the mat 24 when the vessel 20 is in a floating mode. With the preferred configuration of the vessel 20 being cylindrical, a preferred configuration of the mat 24 is ring-shaped. The inside diameter of the mat 24 preferably is slightly greater than the outside diameter of the hull 28 whereby when the vessel 20 is in a floating mode, the circular platform 22 easily nests within the ring-shaped mat 24. The vessel 20 is shown in its floating mode in FIG. 2 where it can be seen that the buoyant ring-shaped mat 24 assists in minimizing the draft of vessel 20.

When the vessel 20 has been floated to the position where the subaqueous operations will be performed, the vessel 20 is placed in contact with the seabed and is supported from the seabed in a manner to enable the vessel to withstand loads imposed upon it by encoraching ice. Preferably the vessel 20 is passively supported from the seabed. This means that no auxillary equipment is necessary to support the vessel 20 in its operating mode and the vessel 20 is entirely self supported.

Preferably the mat 24 and the legs 26 provide the bottom support mechanism for the platform 22. To transform the vessel 20 from its floating mode to a bottom-supported mode, the mat 24 is ballasted and lowered through the water until it engages the seabed. Due to the soil conditions believed to exist for the seabed of the fast ice region of the arctic seas, such as, it is believed the soil comprises 600 psf or less clays and silts and possibly some sands, the mat 24 is preferably embedded within the seabed to enable it to provide sufficient passive structural support for the platform 22. One of two preferred techniques may be used to embed the mat 24 into the seabed. In 600 psf and under clays, the vessel 20 may be preloaded and the mat 24 embedded into the soil under the force of gravity due to such preloading. The preload vessel 20, the mat 24 preferably is completely ballasted, and the hull 28 of the platform 22 is partially ballasted. In silts and clays of greater than 600 psf shear strength in all sands, the penetration of the mat 24 into the soil preferably is accomplished by use of a jetting system. The jetting system hydraulically breaks up the soil beneath the mat 24 permitting the mat 24 to sink into the soil under the force of gravity due to any preloading.

Figure 6:
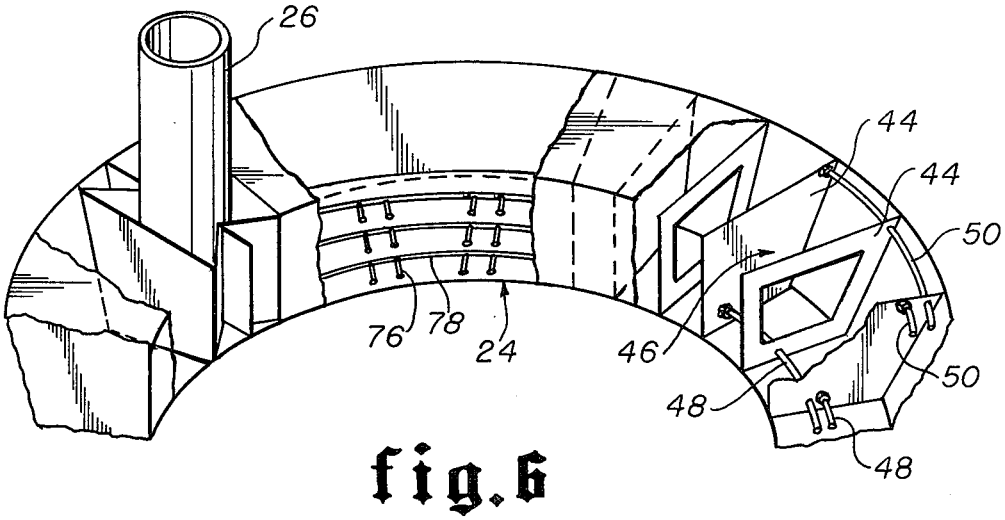
FIG. 6 is a cutaway perspective schematic view taken along 6—6 in FIG. 5 illustrating the construction of the mat of FIG. 5.

FIG. 6 is a cutaway perspective view of a portion of the mat 24 showing its structural arrangement. The mat 24 has appropriate structural bracing including annular struts and sectional bracing (not shown) such as are well known to those skilled in the art. To provide ballast compartments, the mat 24 has a plurality of bulkheads 44 spaced radially around the mat 24 defining a plurality of water compartments 26. Extending to each water compartment 46 is a water line 48 to communicate water to and from the compartment 46 and an air vent line 50 to communicate air to and from the compartment 46.

FIG. 7 illustrates schematically the various equipment that would be utilized to ballast and deballast the mat 24. A sea chest 52 in the mat 24 between any two selected bulkheads 44 provides an intake and discharge point for the ballast water. Water intake for sea chest 52 is provided through port 54 in the mat 24 while water discharge from the sea chest 52 is provided through port 56 in the mat 26. From sea chest 52, water is communicated to a pump 58 is pump room 60 on the platform through conduit 62. A valve 64 controls flow through conduit 62. Pump 58 is capable of pumping water into and out of the various water compartments 46 in the mat. Water is pumped to and from the water compartment 46 by the pump 58 through the water lines 48. When water is pumped into the various water compartments 46, air within the compartments is discharged through air vent line 50. To discharge water from the water compartments 46, air is forced into the water compartments 46 through the air vent lines 50. The water is pumped out of the compartments 46 into the sea chest 52 where it is discharged into the surrounding ocean through the discharge port 56. The pump house 60 preferably is positioned on the deck of the platform and the water lines 48 and the air vent lines 50 communicate with the water compartments by extending through the legs 26.

Figure 10:
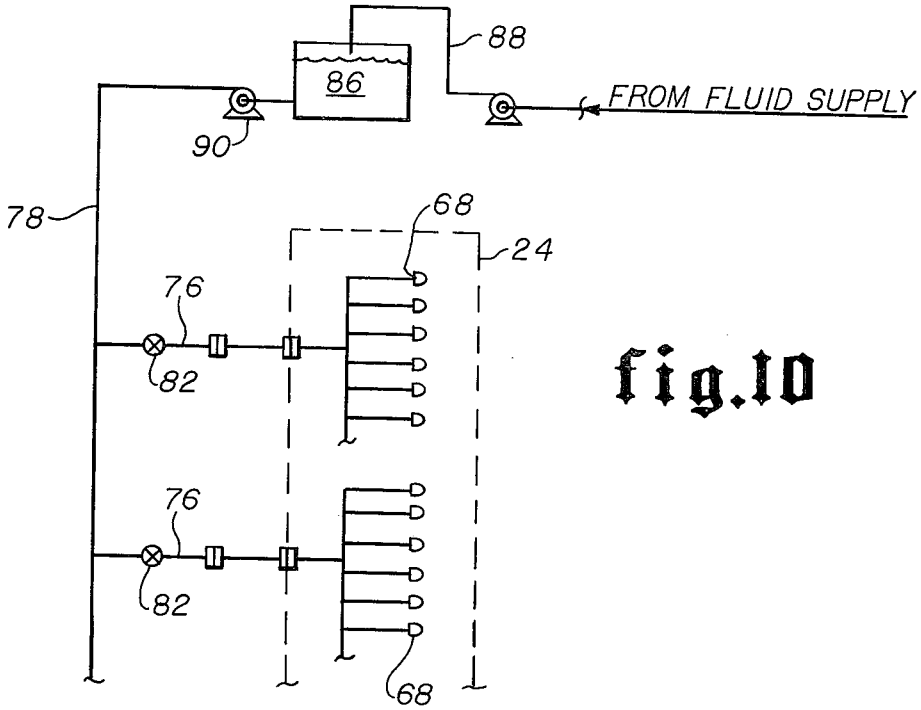
FIG. 10 is a schematic illustration of the nozzle jetting system for the mat of FIG. 5.

To enable the mat 24 to sink into the soil of the seabed when the soil strength will not permit the mat 24 to sink therein under only preload conditions, the hydraulic jetting system is utilized. As seen in FIG. 8, a plurality of jetting nozzles, generally indicated at 68, are disposed around the bottom of mat 24. Fluid is pumped out of each jetting nozzle 68 to hydraulically break up and loosen the soil beneath the mat 24 and to permit the mat 24 to sink therein. A detail of the jetting nozzle 68 is shown in FIG. 9. The jetting nozzle, generally indicated at 68, includes a head 70 projecting beyond the bottom surface of the mat 24. The head 70 has a plurality of appertures 72 therethrough through which fluid is jetted. Jetting fluid is conducted to the nozzle 68 through a conduit 76. FIG. 10 schematically illustrates the circuitry for the jetting system. Each jetting nozzle 68 is supplied with fluid by conduit 76 which is turn fed by manifold 78 mounted within the mat. The jetting fluid is taken from a convenient source of supply (not shown) and pumped by a pump 84 into a reservoir 86 through conduit 88. From reservoir 86 the fluid is pumped by pump 90 through the manifold 78. The flow of the fluid from the manifold 78 through the conduits 76 is controlled by a plurality of control valves 82.

A plurality of legs 26 are attached to the mat 24 and extend upwardly therefrom to support the platform 22 when the vessel 20 is in its operating, bottoms-supported mode. Preferably each leg is attached to the top surface of the mat 24 in order to maximize the ability of leg means 26 to withstand lateral loads due to encoraching ice for a given structural strength. Additionally, the legs preferably are positioned around the platform in a manner designed to minimize the load thereon due to encroaching ice. A minimal load results from a minimal number of leg means 26 positioned equidistant around the mat and platform. Therefore, preferably three legs are provided spaced equal distance around the mat 24. The equal distance spacing and the use of a cylindrical hull 28 and ring-shaped mat 24 also minimize the distance between the leg 26, which in turn maximizes the structural strength possible for the attachment of legs 26 to both the platform 22 and mat 24.

When the vessel is in its bottom-supported mode, subsea operations preferably are performed from the platform 22 in a manner which minimizes the lateral loading upon the vessel 20 due to enroaching ice. There will already be a certain amount of lateral loading upon the vessel 20 due to the encroaching ice acting upon the legs 26. Preferably the subaqueous operations are performed through a selected one of the legs whereby the conduct of such operations results in no additional interaction between the vessel and the ice. To perform subaqueous operations through one of the legs 26, at least one of the legs 26 has a moon pool opening extending therethrough. Additionally, the mat 24 has a corresponding moon pool opening which aligns with the moon pool opening of the leg 26. Extending through such moon pool openings is the equipment for performing the subaqueous operations, such as the drill string, casing and the like.

Figure 11:
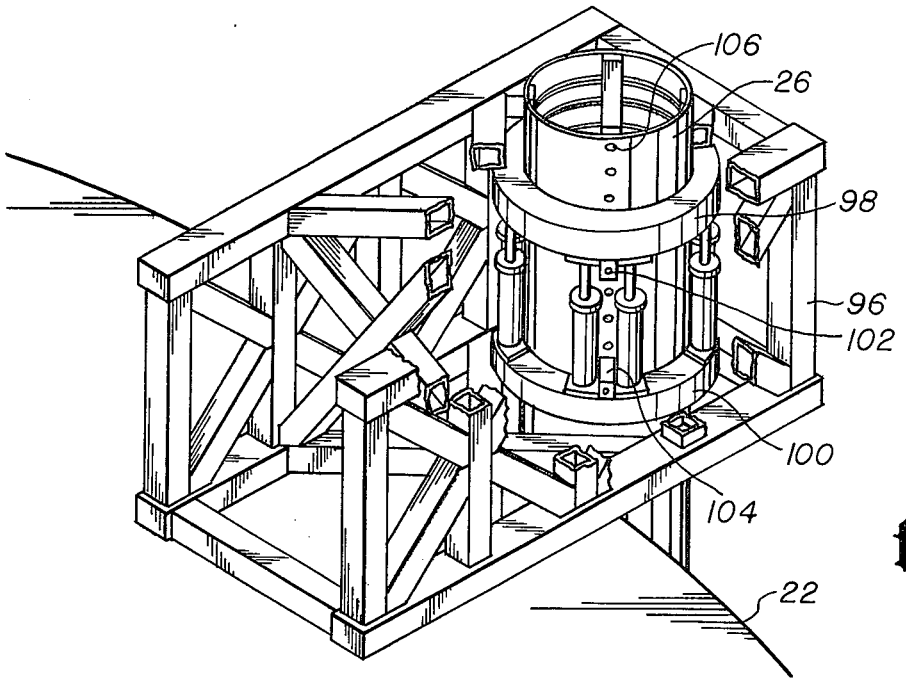
FIG. 11 is a cutaway perspective view of the leg jackup system associated with the vessel of FIGS. 1 through 4.

Means are associated with the platform 22 for attaching the legs 26 to the platform 22 and for selectively moving the legs relative to the platform. A preferred attaching and moving means for the legs is shown in FIG. 11. The attaching and moving means permits each leg to extend therethrough and includes appropriate bracing and framework 96 to associate the moving means with the platform 22. The moving means may comprise a jack-up system as disclosed in United States Pat. Nos. 2,920,870 and 2,822,670 to Suderow, the entire disclosure of both patents being hereby incorporated by reference. As disclosed in the aforementioned patents, an upper jacking collar 98 and a lower jacking collar 100 are positioned around each leg means 26. Each jacking collar 98 and 100 has a pin holder 102 and 104, respectively, through which pin means are projected into holes 106 spaced longitudinally along the leg 26. Positioned between the upper and lower jacking collars 98 and 100 are jacking piston and cylinder assemblies 110. The jacking piston and cylinder assemblies 110 are capable of extending or retracting to move the jacking collars 98 and 100 with respect to each other. By selectively operating the piston and cylinder assemblies and selectively pinning the collars to the leg, the leg may be moved vertically relative to the platform 22 and, if the leg is held stationary by the seabed, the platform may be moved vertically relative to the leg.

Figure 2:
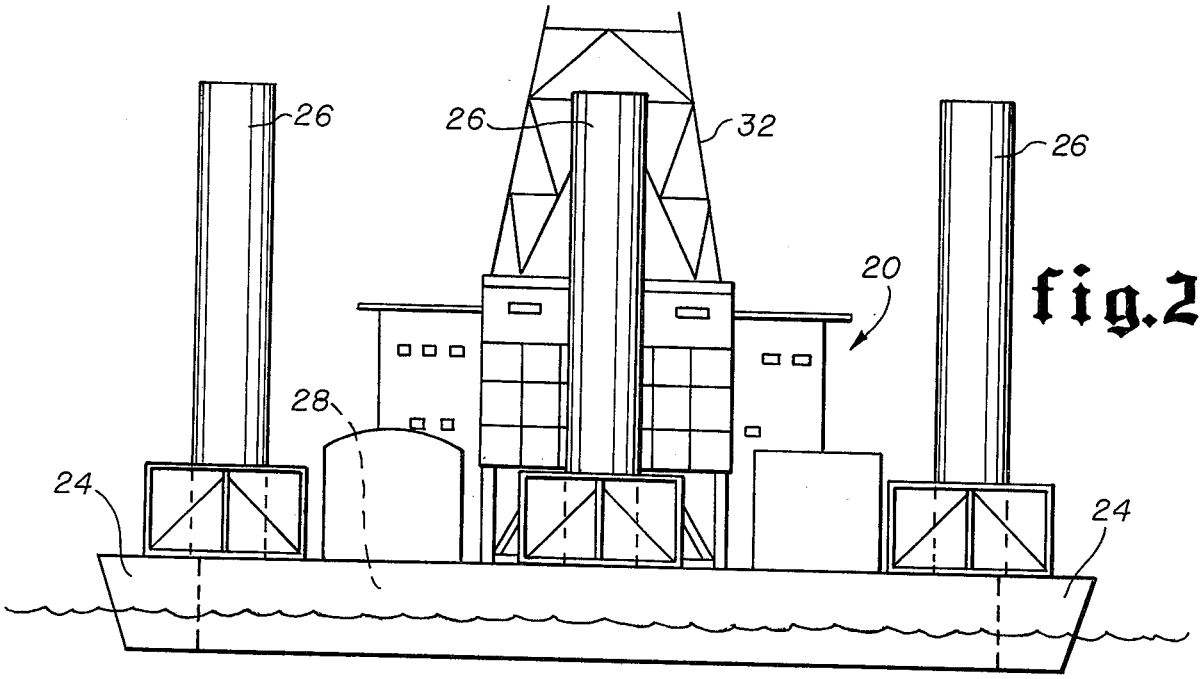
FIG. 2 is a front view of the vessel, in elevation, when the vessel is in a floating mode.
Figure 3:
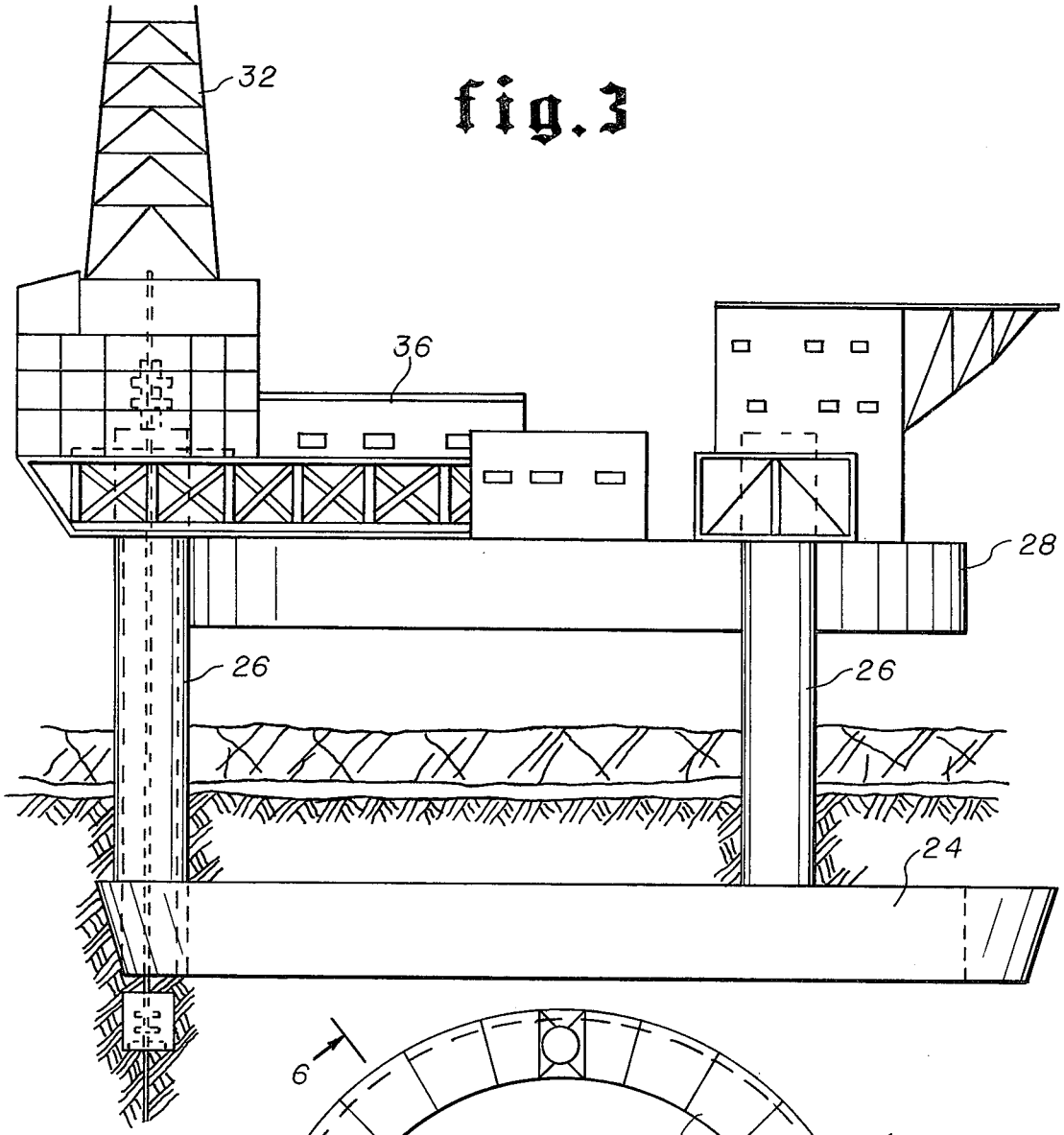
FIG. 3 is a side view of the vessel, in elevation, when the vessel is in a bottom-supported position for performing subaqueous operations.
Figure 5:
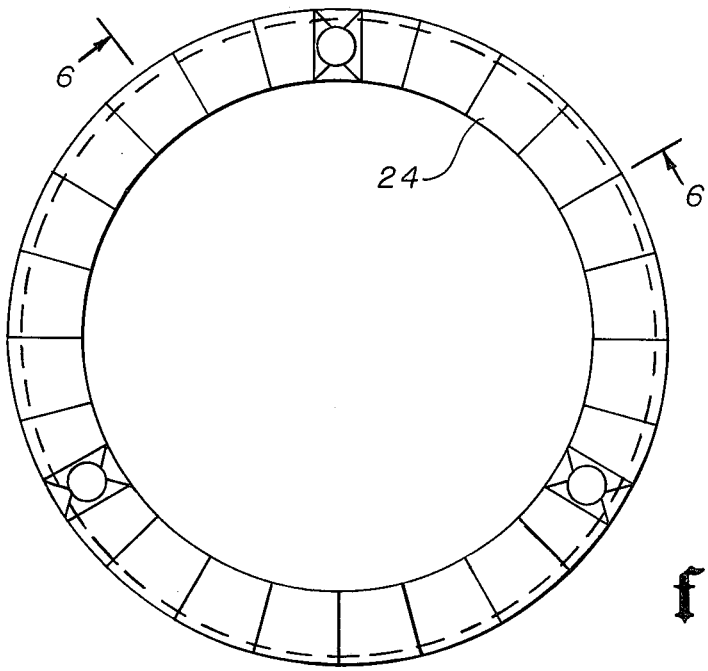
FIG. 5 is a top view of the mat of the vessel of FIGS. 1 through 4.
Figure 4:
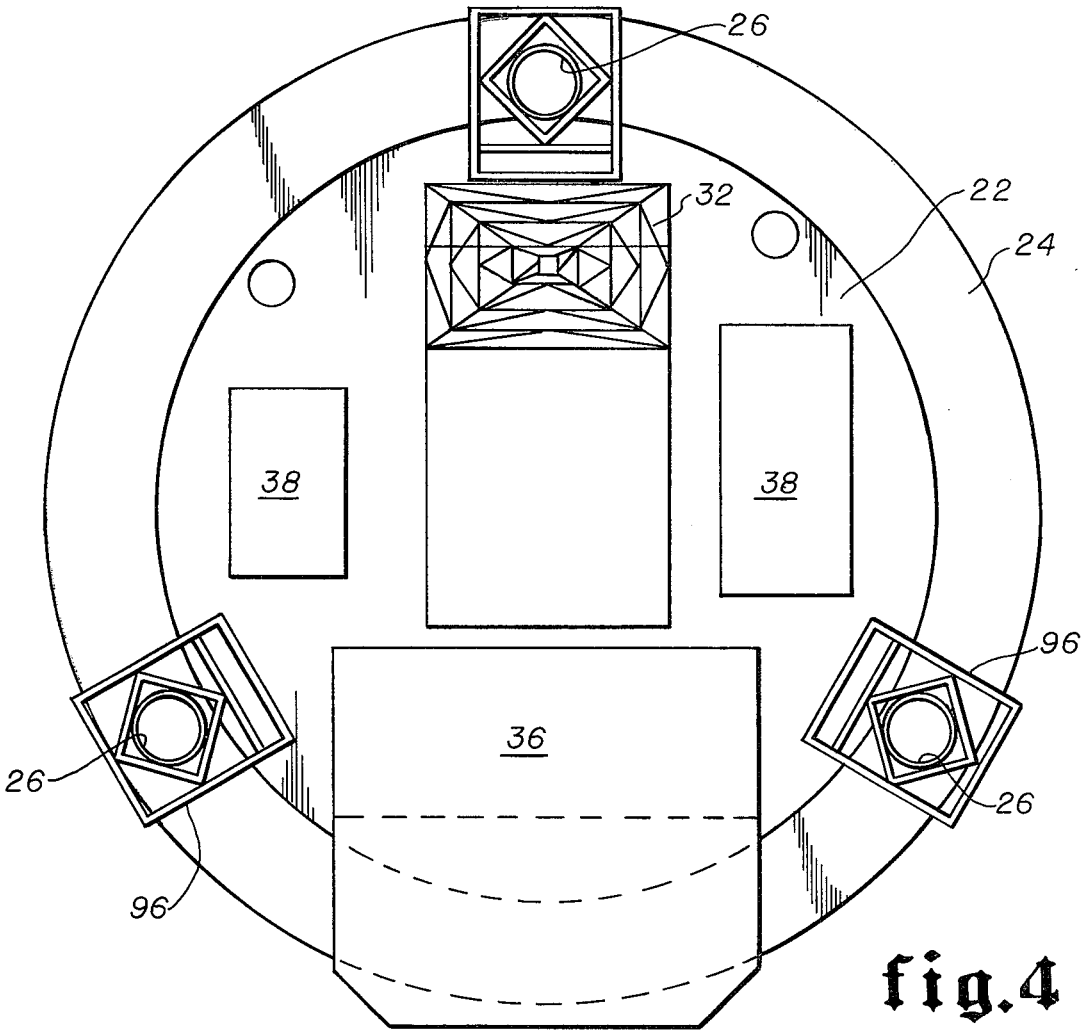
FIG. 4 is a top view of the vessel.

In operation, the vessel 20 may be transported from one location to another wherever it is desired to perform subaqueous operations. The mat is deballasted and the legs are jacked upwardly with respect to the platform to their extreme upward position as illustrated in FIG. 2. The vessel is floated to the desired location with the platform 22 nested within the mat 24. The nesting of the platform 22 within the mat 24 reduces the draft of the vessel 20 and enables the vessel to be floated to a shallow water location in the arctic seas.

Once the vessel 20 has reached the location where subaqueous operations will be performed, a bottom supported platform for performing these operations is provided by jacking the legs downwardly with respect to the platform whereby the mat is lowered to the ocean bottom. Thereafter, the mat is ballasted and the moving means for the legs are again activated. The legs are jacked downwardly with respect to the platform and the mat is embedded into the seabed in order to provide sufficient load resistant capabilities for the platform and to eliminate ice scouring on the mat. If the soil is sufficiently weak (for example clays under 600 psf), the vessel 22 is preloaded as by ballasting the mat 24 and hull so that the mat 24 will sink into the soil due to the force of gravity. If the soil strength is such that preloading will not be sufficient to sink the mat into the soil (for example in silts and clays over 600 psf and in all sands), the soil is broken up beneath the mat 24 to aid the mat in sinking into the seabed. To break up the soil beneath the mat 24, pumps 84 and 90 are activated and jetting fluid is conducted from the supply source (not shown) through the reservoir 96 supply manifolds to the jetting nozzles 68 where it jets downwardly from the bottom of the mat 24 and hydraulically breaks up the soil beneath the mat 24 enabling it to sink into the seabed.

Once the mat has penetrated into the seabed a sufficient distance to enable it to provide any required load resistance capabilities for the platform, the preloading and jetting is discontinued. Thereafter, the platform is jacked upwardly with respect to the now stationary legs whereby the platform is raised out of the water. The platform is raised out of the water a sufficient so that the hull 28 will not be affected by encroaching ice or wave action. Once the vessel 20 is in its bottom-supported position, the subaqueous operations are performed from the platform 22 through a moon pool opening extending through a selected one of the legs so that the lateral loading imposed upon the vessel 20 is minimized.

Once the desired operations have been performed in one location, the vessel 20 may be moved to another location. To do so, the hydraulic jetting system is actuated and the mat 24 is removed from the soil as by raising the legs with respect to the platform until the mat is dislodged from its soil penetrated position. The legs are moved upwardly until they have reached their extreme upward position wherein the hull 28 nests within the mat 24 and the vessel 20 has obtained its minimal draft. The vessel 20 can then be floated to a new location.

From the foregoing it can be seen that the improved vessel for performing subaqueous operations according to this invention provides a minimal draft to enable it to be floated into the shallow fast ice arctic sea regions. The vessel is adapted to enable it to assume a bottom-supported configuration which minimizes load effects on the vessel. It will be apparent to those skilled in the art that the foregoing disclosure and description of the invention is illustrative and explanatory, and various changes may be made in the size, shape and construction of the improved vessel as well as in the manner of its operation within the scope of the appended claims without departing from the spirit of the invention.

We claim:

1. A bottom-supported vessel from which subaqueous operations may be performed, comprising:

a circular platform including a buoyant cylindrical hull and a circular deck mounted on the top of the hull from which subaqueous operations may be performed;

a ring-shaped floatable mat;

the outside diameter of the platform and the inside diameter of the mat being such that the hull may nest within the mat when the vessel is in its floating mode;

means for ballasting and deballasting the mat;

legs attached to the mat and extending upwardly from the mat;

means associated with the platform for moving the legs relative to the platform; and means for embedding said mat into the soil at the bottom of a body of water.

2. A method of establishing the arctic conditions a bottom-supported vessel from which subaqueous operations may be performed, which vessel includes a buoyant hull that is connected to an encircling ballastible and deballastible mat by a plurality of legs, and which vessel includes means for moving the legs vertically relative to the hull, comprising the steps of:

deballasting the mat;

moving the legs upwardly relative to the floating hull until the hull nests within the encircling floating mat;

floating the vessel into the selected position for performing the subacqueous operations;

ballasting the mat;

moving the legs downwardly with respect to the hull in order that the mat contacts the seabed;

jetting hudraulic fluid downwardly from the bottom of the mat to break up the subsea soil beneath the mat;

continuing to move the legs downwardly with respect to the hull until the mat is embedded in the seabed; and ceasing the jetting of the hydraulic fluid and continuing to move the legs vertically with respect to the hull whereby the hull is raised from the sea.

3. An improved vessel for carrying equipment for performing subaqueous operations, which vessel may be floated into position and once in position may be placed in contact with the seabed whereby the vessel is supported by the seabed while subaqueous operations are performed from the vessel, comprising:

a bouyant platform for supporting the equipment for performing the subaqueous operations, the platform having a hull and a deck;

means associated with the platform for ballasting and deballasting the platform;

a ballastible and deballastible mat configured such that the hull of the platform nests within the mat when the mat is fully deballasted;

means associated with the mat and the platform for ballasting and deballasting the mat;

a plurality of upwardly extending legs attached to the mat at selected positions thereon;

jacking means attached to the platform for gripping the legs of the platform and moving the legs vertically relative to the platform; and hydraulic jetting means associated with the mat and adapted to jet fluid downwardly to remove soil from beneath the mat whereby the mat may be embedded in the seabed.

* * * * *